US008635850B1

(12) United States Patent
Light et al.

(10) Patent No.: US 8,635,850 B1
(45) Date of Patent: Jan. 28, 2014

(54) ION ELECTRIC PROPULSION UNIT

(75) Inventors: Max E. Light, Los Alamos, NM (US); Patrick L. Colestock, Santa Fe, NM (US)

(73) Assignee: U.S. Department of Energy, Washington, DC (US)

( * ) Notice: Subject to any disclaimer, the term of this patent is extended or adjusted under 35 U.S.C. 154(b) by 1316 days.

(21) Appl. No.: 12/201,071

(22) Filed: Aug. 29, 2008

(51) Int. Cl.
*F03H 1/00* (2006.01)

(52) U.S. Cl.
USPC ..... 60/202; 313/359.1; 315/111.61

(58) Field of Classification Search
USPC ..... 60/202, 203.1; 313/359.1–363.1; 315/111.21, 111.41, 111.61
See application file for complete search history.

(56) References Cited

U.S. PATENT DOCUMENTS

| | | | | |
|---|---|---|---|---|
| 4,825,646 | A * | 5/1989 | Challoner et al. | 60/202 |
| 5,107,170 | A * | 4/1992 | Ishikawa et al. | 313/362.1 |
| 5,241,244 | A | 8/1993 | Cirri | |
| 6,205,769 | B1 * | 3/2001 | Brandenburg et al. | 60/203.1 |
| 6,396,211 | B1 | 5/2002 | Satori | |
| 2006/0066248 | A1 * | 3/2006 | Chistyakov | 315/111.21 |
| 2007/0234705 | A1 | 10/2007 | Emsellem | |
| 2008/0035865 | A1 * | 2/2008 | Komori et al. | 250/504 R |

OTHER PUBLICATIONS

Stallard et al., "Whistler Wave Driven Plasma Thruster", UCRL-JC-110921, Oct. 5, 1992, submitted to Tenth Symposium on Space Nuclear Power and Propulsion.
Foster et al, High Power Electric Propulsion (HiPEP) Ion Thruster, NASA/TM-2005-213194, AIAA-2004-3812, Sep. 2004.
Drentje et al, "Experiments with biased Cylinder in Electron Cyclotron Resonance Ion Source", Rev. Sci. Inst. 75, 1399, May 13, 2004.
Light et al, "Development of a Plasma Cathode Electron (PCE) Source for Use in a Plasma Thruster", presentation at 48th Annual APS Mtg., Nov. 2, 2006.

* cited by examiner

*Primary Examiner* — Andrew Nguyen
(74) *Attorney, Agent, or Firm* — Thomas S. O'Dwyer; James C. Durkis; John T. Lucas

(57) ABSTRACT

An electron cyclotron resonance (ECR) thruster is disclosed having a plasma chamber which is electrically biased with a positive voltage. The chamber bias serves to efficiently accelerate and expel the positive ions from the chamber. Electrons follow the exiting ions, serving to provide an electrically neutral exhaust plume. In a further embodiment, a downstream shaping magnetic field serves to further accelerate and/or shape the exhaust plume.

5 Claims, 5 Drawing Sheets

ION ELECTRIC PROPULSION UNIT

STATEMENT REGARDING FEDERALLY SPONSORED RESEARCH OR DEVELOPMENT

The United States Government has rights in this invention pursuant to Contract No. W-7405-ENG-36 between the United States Department of Energy National Nuclear Security Administration and Los Alamos National Security, LLC for the operation of Los Alamos National Laboratory.

CROSS-REFERENCE TO RELATED APPLICATIONS

None

REFERENCE TO A "SEQUENCE LISTING", A TABLE, OR A COMPUTER PROGRAM LISTING APPENDIX SUBMITTED ON COMPACT DISC AND AN INCORPORATION-BY-REFERENCE OF THE MATERIAL ON THE COMPACT DISC

Not Applicable

BACKGROUND OF THE INVENTION

1) Field of the Invention

The present invention relates generally to an ion electric propulsion unit, and particularly to a microwave electron cyclotron resonance (ECR) propulsion unit in which the ECR plasma chamber is electrically biased to a positive potential.

2) Background of the Problem and Description of Related Art Including Information Disclosed Under 37 CFR 1.97 and 37 CFR 1.98

Electric propulsion has long held promise over chemical rockets as a means to provide greater thrust via higher exhaust velocities. Electrothermal propulsion units electrically heat propellant that is then expanded through a nozzle to deliver thrust to the unit. Electrostatic propulsion units overcome fundamental thermal limitations (conversion of thermal energy into kinetic energy) of electrothermal units by accelerating propellant by application of an external body force. In a simple ion thruster, a beam of positive ions is accelerated by an electric field and subsequently neutralized by an equal flux of free electrons. In certain ion thrusters, discharge cathodes are used to produce the plasma which makes cathode life a key concern. Cathode failure can occur due to physical sputter erosion (from plasma on cathode ion bombardment in the plasma), and emitter element failure. Use of electron cyclotron resonance to generate the plasma eliminates the need for the cathode, potentially increasing the life of the thruster. Typically in ion thrusters, the ions are "extracted" from the plasma chamber and accelerated by electrode "grids" downstream of the plasma chamber. Use of such "grids" has certain disadvantages, including: a) "extracting" the ions is inefficient; b) electron backstreaming can occur causing the grid apertures to widen due to erosion; c) presence of conducting flakes from electrode erosion can lead to shorting that would terminate extraction; d) failure of the grid electrodes due to erosion; e) space charge limitations provide a fundamental limit on ion extraction. If too many ions collect near the grid, their "self field" will be strong enough to turn back other ions trying to pass the grid, limiting the ion current ("space charge limited current flow").

U.S. Pat. No. 6,396,211 discloses a microwave discharge electrostatic accelerator propulsion device utilizing acceleration electrodes disposed in the discharge chamber.

Published U.S. Patent Application 2007/0234705 discloses an ECR thruster that utilizes magnetized ponderomotive force for accelerating the plasma.

BRIEF SUMMARY OF THE INVENTION

In the present invention, an electron cyclotron resonance ion thruster utilizes at least one electrode disposed in electrical contact with the wall of the plasma chamber, with this electrode serving to bias the chamber to a positive electrical potential. At least one first magnet is disposed to generate a cyclotron magnetic field that is coaxial with the long axis of the chamber. The cyclotron magnetic field causes (plasma) propellant electrons to follow a cyclotron spiral path along the long axis in the chamber. A microwave generator supplies microwaves to propellant electrons resident in the chamber. Preferably the microwave frequency is at or near the cyclotron frequency of the electrons, to maximize microwave excitation of the electrons which ionize at least a portion of the propellant as the excited electrons collide with propellant molecules. The positive bias of the chamber exerts an electrostatic force on positive ions causing them to accelerate. The chamber has an exit aperture through which the accelerated ions are discharged. As the positive ions are discharged from the chamber, electrons (having much greater mobility) will follow the positive ions, creating a charge neutral exhaust plume. Variable exhaust velocity of the plume may be achieved by varying the bias on the electrode.

In operation, the electrons are constrained to travel along the lines of the magnetic field, which insulates the inner walls of the plasma chamber from the plasma. In a further embodiment, the inner walls of the chamber that are not covered by the electrode have an electrically insulating coating.

In a further embodiment, at least one second magnet is disposed in the region proximal to the chamber exit aperture, oriented along the long axis of the chamber, to generate a downstream shaping magnetic field. The shaping magnetic field is oriented to accelerate said ions, shape the plume, or combination of the foregoing. The shaping magnetic field strength may be varied so as to vary the exhaust velocity of the plume.

DETAILED DESCRIPTION OF THE INVENTION

Figure 1:
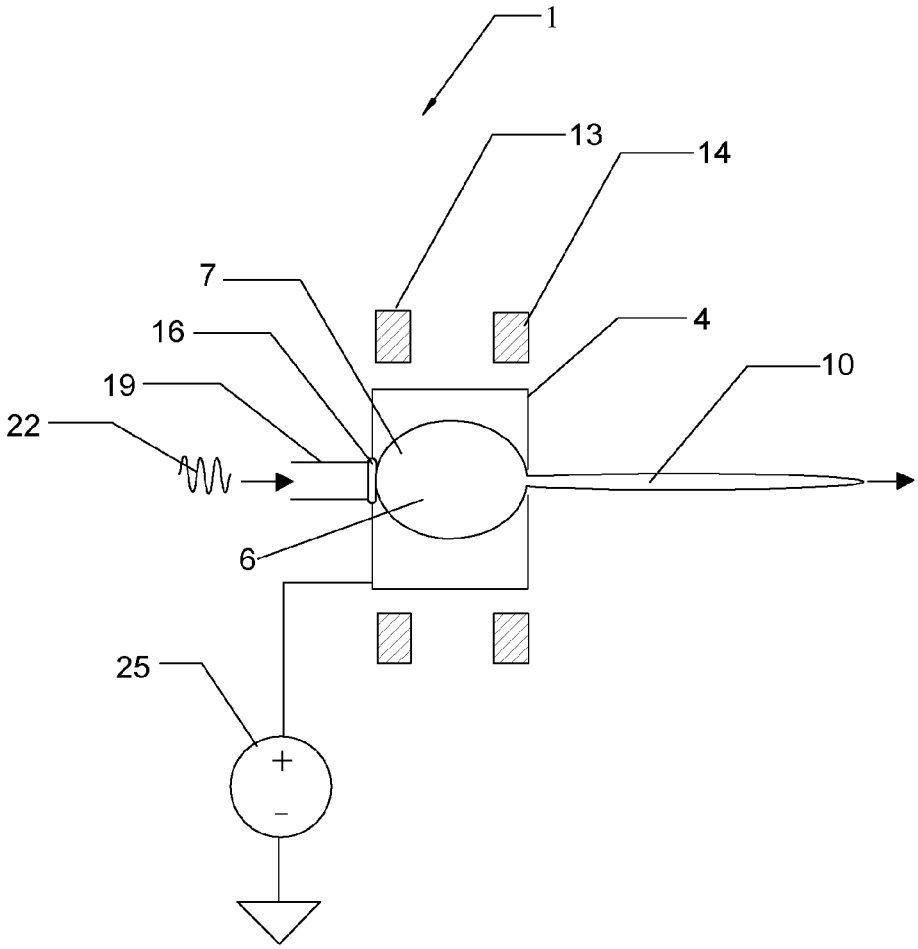
FIG. 1 provides a schematic of the present invention
Figure 2A:
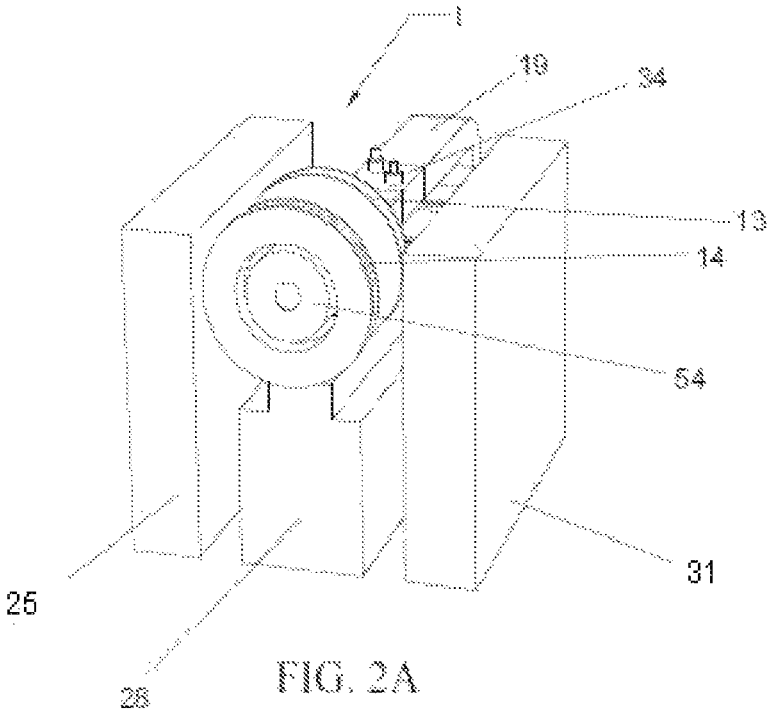
FIGS. 2A-2D provide perspective views of the present invention
Figure 2B:
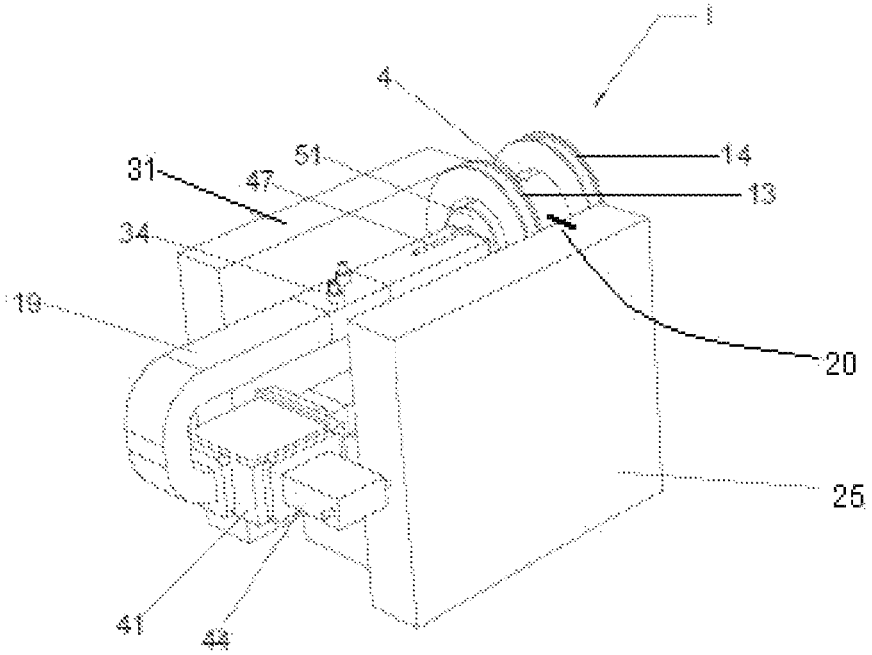
Figure 2C:
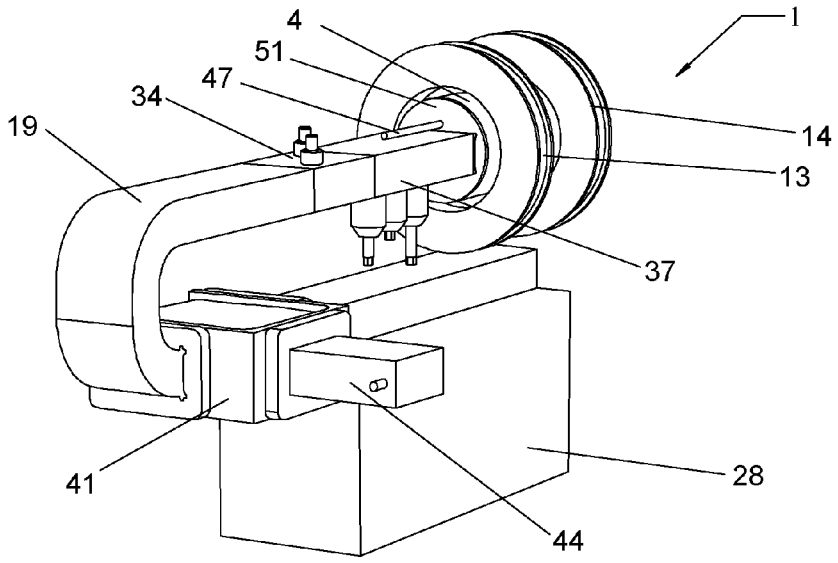
Figure 2D:
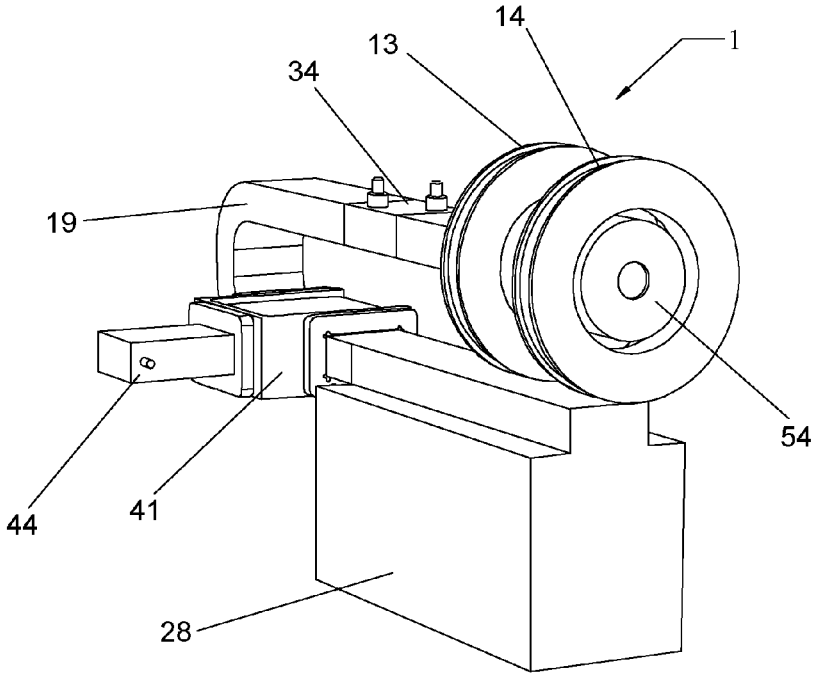

In the present invention, an electron cyclotron resonance ion thruster achieves efficient expulsion of ions from the plasma chamber by electrically biasing the chamber to a positive electrical potential. Biasing the chamber is more efficient than use of a downstream electrostatic field by avoiding lifetime issues associated with use of a downstream field. Downstream fields require a downstream grid upon which to apply the electric potential. The grid gets bombarded with the massive ions as they escape the chamber, resulting in grid ion sputtering (material sputtered off the grid) greatly reducing grid lifetime. In the biased chamber, the ions leave, and the electrons must be "sunk" to the chamber walls. Electrons are much less massive, and only contribute to a heating of the chamber walls, not sputtering. Furthermore, a downstream grid has limitations on the amount of ion flux allowed to pass through. If too many ions collect near the grid, their "self field" will be strong enough to turn back other ions trying to pass the grid. This limits the ion current, known as space charge limited current flow. By biasing the chamber, the ions are expelled, rather than pulled out (via a downstream electrostatic field). The power required to bias the chamber is on the same order as that required for a downstream electrostatic potential, providing the aforementioned lifetime and ion current advantages without suffering a power penalty. Biasing the chamber can provide superior performance compared to acceleration grids. Biasing the chamber can provide greater surface area for accelerating the ions. By making at least one or portions of the plasma chamber wall electrically conducting, the bias electrode(s) may be placed outside or inside the plasma, in electrical contact with the electrically conducting plasma chamber wall portion(s). In further embodiments, bias electrode(s) disposed within the chamber may have a protective coating or covering to protect them from the plasma environment.

In a further embodiment, at least one magnet is disposed to generate a shaping magnetic field (through varying the current to the coil) in said chamber, in the region proximal to the chamber exit aperture. The shaping magnetic field is oriented to accelerate said ions, shape the plume, or combination of the foregoing. The shaping magnetic field strength may be varied so as to vary the exhaust velocity of the plume. The shaping magnetic field enhances the ions' ability to get off the field lines and escape (to preclude the ions' return and nullifying thrust). The field also acts as an energy filter for the ions, wherein ions start at a low field region and escape out of a high field region, exhibiting higher energy. The "flaring" of the weakening field lines creates a potential difference favorable to ejection of the ions. The magnetic nozzle will create supersonic downstream plasma flow which leads to detachment of the propellant from the magnetic field lines and the generation of thrust.

FIG. 1 provides a schematic for the ECR thruster 1 of the present invention. At least one first magnet 13 generates a coaxial magnetic field in plasma chamber 4 causing electrons in gaseous propellant 6 to follow a cyclotron spiral path in the plasma chamber 4. Microwaves 22 from a microwave generator 28 travel via waveguide 19 through a window 16 which is mounted upon chamber entry plate 51 for providing communication to gaseous propellant 6 present within the plasma chamber 4. Gaseous propellant 6 may be any gas suitable for such purposes, including but not limited to: Ar, Ne, He, $H_2$, Xe and $N_2$. Preferably the microwave frequency is at or near the cyclotron frequency of the electrons, to maximize microwave excitation of the electrons which ionize at least a portion of the propellant as the excited electrons collide with propellant molecules generating plasma 7. The object is to have an ECR resonance zone close to the microwave window 16 (0.0875 Tesla field strength for a magnetron frequency of 2.45 GHz). Plasma chamber 4 is biased to a positive electrical potential via plasma chamber bias power supply 25, via at least one electrode 20 in electrical contact with the wall of plasma chamber 4. The positive bias of the plasma chamber 4 exerts an electrostatic force on positive ions causing them to accelerate and exit plasma chamber 4 through an exit aperture as plasma plume 10. As the positive ions are discharged from the plasma chamber 4, electrons (having much greater mobility) will follow the positive ions, creating a charge neutral exhaust plume. Variable exhaust velocity of the plasma plume 10 may be achieved by varying the bias on the electrode. The plasma chamber 4 wall surfaces are composed of non-magnetic conducting material (such as 316 stainless steel) so as to not interfere with the ECR magnetic field. In one embodiment, the plasma chamber 4 wall is composed of electrically conducting material to enable application of an electrical bias to the plasma chamber. In another embodiment, the end portions of the plasma chamber 4 wall (end proximal to microwave entry, and end proximal to ion exit) are composed of electrically conducting material, with the plasma chamber 4 wall sections between the end portions being composed of non-electrically conducting material. Although some electrons will follow escaping ions, other electrons will impinge on the plasma chamber 4 walls, creating a heat flux. In preferred embodiments, means to remove this heat load is present.

In operation, the electrons are constrained to travel along the lines of the magnetic field, which insulates the inner walls of the plasma chamber 4 from the plasma 7. In a further embodiment, the inner walls of plasma chamber 4 have an electrically insulating coating (not shown).

In a further embodiment, at least one second magnet 14 is disposed to generate a shaping magnetic field (through varying the current to the coil) in said chamber, in the region proximal to the chamber exit aperture. Magnets 13 and 14 both contribute to the cyclotron resonance of the electrons as well as the downstream field profile, wherein upstream magnet 13 contributes more to the cyclotron resonance of the electrons, and magnet 14 contributes more to the downstream field shaping. The shaping magnetic field is oriented to accelerate said ions, shape the plume, or combination of the foregoing. The shaping magnetic field strength may be varied so as to vary the exhaust velocity of the plume. Magnets 13 and 14 may be permanent magnets, coils, or combinations of both. For thrust applications, the masses of the magnets are one important consideration (less mass being preferred), which may point to the use of high temperature superconducting magnets in certain situations. Magnets 13 and 14 are both oriented along the long axis of the plasma chamber.

FIGS. 2A-2D provide perspective views of an exemplary ECR thruster of the present invention. Magnet 13 generates a coaxial magnetic field in plasma chamber 4 causing electrons in gaseous propellant present in plasma chamber 4 to follow a cyclotron spiral path in plasma chamber 4. Microwaves from microwave generator 28 travel via waveguide 19 through window 16 providing communication with gaseous propellant provided to plasma chamber 4 via gas feed 47 that penetrates entry plate 51, the microwaves serving to excite propellant electrons that collide with and ionize propellant molecules. Plasma chamber 4 is biased to a positive electrical potential via magnet and plasma chamber bias power supply 25. The positive bias of plasma chamber 4 exerts an electrostatic force on the positive ions causing them to accelerate and exit plasma chamber 4 through exit aperture plate 54. Plasma chamber bias voltages would be in the range of 500-1000 volts. In further embodiments, magnet 14 in combination with magnet 13 creates a shaping magnetic field downstream of said exit aperture plate 54 that serves to further accelerate said ions, shape the plume, or combination of the foregoing. Magnets 13 and 14 receive power from magnet and plasma chamber bias power supply 25. In other embodiments, power may be supplied to the magnet(s) and plasma chamber from separate power supplies. With microwave generator power supply operating at about 2-3 kW, magnet(s) power supply 31 operating at about 20-25 kW for magnet field strengths at about 0.05-0.15 Tesla, expected thrust would vary up to around 0.5 Newtons. Each magnet would be independently fed in terms of power so as to change the field from each coil independently. The shaping magnetic field strength may be varied so as to vary the exhaust velocity of the plume. The shaping magnetic field enhances the ions' ability to get off the field lines and escape (to preclude the ions' return and nullifying thrust). The field also acts as an energy filter for the ions. If the ions start at a low field region in the source and escape out a high field region, they must have more energy. Further downstream, the "flaring" of the weakening field lines will create a potential difference favorable to pulling the ions out (without a grid). Power circulator 41 allows power to flow in only one direction relative to microwave generator 28, protecting microwave generator 28 from large power reflections. Any power reflected back to the source from the plasma source is shunted to cooled load 44. Power tuner 37 is adjusted to maximize forward power (to the plasma source) and minimize reflected power. Power diagnostic 34 monitors the forward and reflected power to and from the plasma source so the power tuner 37 can be adjusted to make the most efficient match possible (maximum power delivery and minimum power reflected).

Figure 3:
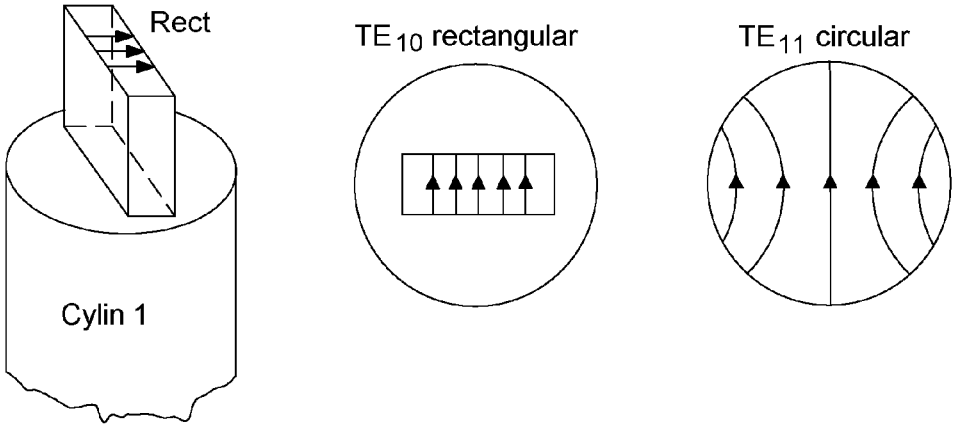
FIG. 3 illustrates conversion of the microwave feed

As shown in FIG. 3, a magnetron microwave feed, TE10 rectangular to TE11 circular mode converter is used. To achieve efficient plasma generation, electron cyclotron resonance at 2.45 GHz in an 875 Gauss magnetic field is preferably utilized.

Expected thrust (newtons) and specific impulse (seconds) may be calculated (estimated) as follows Assume an argon plasma at a density of $2.5\times10^{19}$ $m^{-3}$ from the microwave source—continually replenished by the magnetron power supply. Let all of the ions escape with the electrons at a drift velocity defined by the bias applied to the plasma chamber through a 1 cm radius aperture; and let the potential they fall through be the full bias potential.

The ion escape velocity $V_i$ will be $$V_i=\sqrt{2q\Phi/m_i}\,(m/s)$$

where $\Phi$ is the potential in volts, $m_i$ is the argon ion mass, and q is the ion charge.

The thrust T of the system as a function of chamber bias is as follows:

$$T=V_i^2 n_i m_i A \text{ (newtons)}$$

where $n_i=n_0$=plasma density ($m^{-3}$), and A=aperture area ($m^2$).

The specific impulse $I_{sp}$ of the system as a function of chamber bias is as follows:

$$I_{sp}=V_i/g \text{ (seconds)}$$

where g=earth's gravitational constant 9.8 $m/s^2$.

Figure 4A:
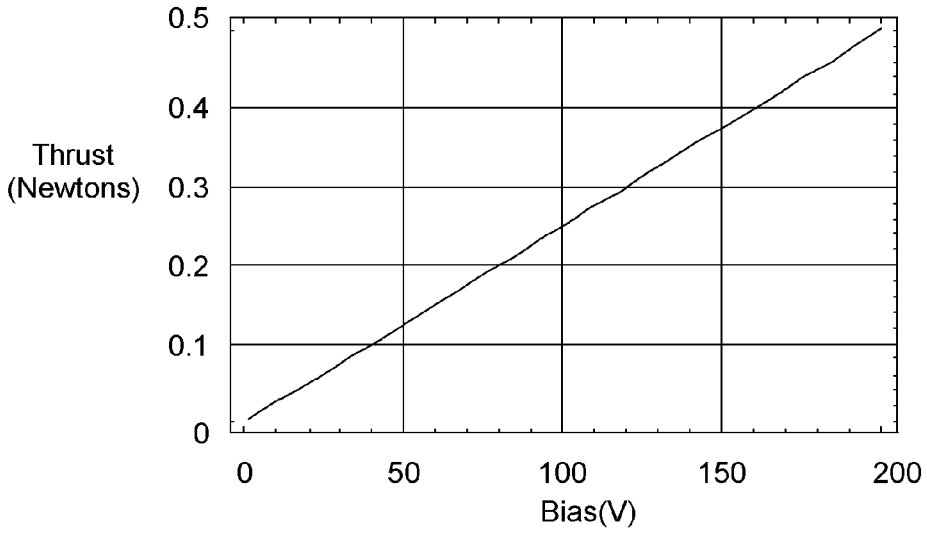
FIGS. 4A and 4B present curves for calculated thrust and specific impulse vs. bias voltage
Figure 4B:
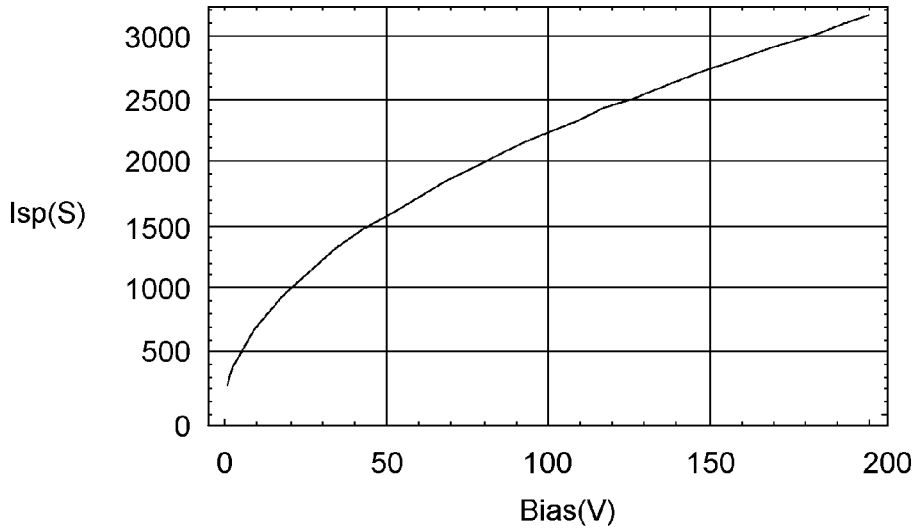

FIG. 4A provides a curve of estimated calculated thrust vs. bias voltage. FIG. 4B provides a curve of the calculated specific impulse (seconds) vs. bias voltage for argon. The above calculations neglect any form of efficiency in plasma production or conversion from chamber bias to acceleration, thus providing upper limits for a $n_0=2.5\times10^{19}$ $m^{-3}$ argon plasma biased up to 200 volts. This shows that $I_{sp}$ and thrust are variable through a wide range.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An electron cyclotron resonance thruster comprising:

a plasma chamber comprised of non-magnetic conducting material, with at least a portion of said plasma chamber being electrically conducting;

a source of ionizable propellant gas in fluid communication with said plasma chamber;

at least one first magnet disposed to generate a magnetic field in said chamber, coaxial with the long axis of said chamber;

a microwave generator;

means for coupling microwaves comprising a waveguide from said generator to an entry window provided in said chamber in order to ionize neutral propellant gas electrons in said propellant present within said chamber, said microwaves serving to excite said electrons, resulting in said excited electrons ionizing at least a portion of said propellant within said chamber, thereby generating a plasma;

at least one electrode disposed to be in electrical contact with the electrically conducting portion of said chamber;

a power supply connected to said electrode serving to bias said chamber wall to a positive electrical bias voltage, wherein said positively biased chamber exerts an electrostatic force on positive ions in said plasma serving to accelerate said positive ions;

and wherein said chamber has an exit aperture without a grid through which said accelerated positive ions exit from said chamber;

and at least one second magnet disposed in the region proximal to said chamber exit aperture and oriented along the long axis of said chamber, to generate a downstream shaping magnetic field;

wherein said downstream shaping magnetic field is oriented to accelerate said positive ions, shape the plume, act as an energy filter, or a combination of the foregoing.

2. The thruster of claim 1 wherein:

the entire plasma chamber wall is comprised of electrically conducting material.

3. The thruster of claim 1 wherein:

at least the end regions of said plasma chamber, i.e. the chamber end proximal to where microwaves enter and the chamber end proximal to where said positive ions exit, are comprised of electrically conducting material.

4. The thruster of claim 1 wherein:

said bias voltage applied to said at least one electrode is adjustable to achieve a variable velocity of the exhaust plume.

5. The thruster of claim 1 wherein:

the strength of said downstream shaping magnetic field is adjustable to vary the exhaust velocity of said positive ions.

* * * * *